US010647561B2

(12) United States Patent
Devaux et al.

(10) Patent No.: US 10,647,561 B2
(45) Date of Patent: May 12, 2020

(54) LIFTING APPLIANCE AND METHOD FOR USING SUCH A LIFTING APPLIANCE

(71) Applicant: HAULOTTE GROUP, L'Horme (FR)

(72) Inventors: Christian Devaux, Saint Etienne (FR); Thierry Granjon, Messimy (FR)

(73) Assignee: HAULOTTE GROUP, L'Horme (FR)

( * ) Notice: Subject to any disclaimer, the term of this patent is extended or adjusted under 35 U.S.C. 154(b) by 0 days.

(21) Appl. No.: 15/565,931

(22) PCT Filed: Apr. 13, 2016

(86) PCT No.: PCT/EP2016/058124
§ 371 (c)(1),
(2) Date: Oct. 12, 2017

(87) PCT Pub. No.: WO2016/166162
PCT Pub. Date: Oct. 20, 2016

(65) Prior Publication Data

US 2018/0050894 A1 Feb. 22, 2018

(30) Foreign Application Priority Data

Apr. 14, 2015 (FR) ..... 15 53262

(51) Int. Cl.
*B66F 11/04* (2006.01)
*B66F 17/00* (2006.01)

(52) U.S. Cl.
CPC ..... *B66F 17/006* (2013.01); *B66F 11/04* (2013.01)

(58) Field of Classification Search
CPC ..... B66F 17/006; B66F 11/04
See application file for complete search history.

(56) References Cited

U.S. PATENT DOCUMENTS 3,170,733 A * 2/1965 Lamme ..... B60B 7/16 301/37.21
3,856,108 A * 12/1974 Grove ..... B66F 11/046 182/16

(Continued)

FOREIGN PATENT DOCUMENTS

CN 1122761 5/1996
CN 202687898 1/2013

(Continued)

OTHER PUBLICATIONS

International Search Report, dated Jun. 20, 2016, from corresponding PCT/EP2016/058124 application.

*Primary Examiner* — Alvin C Chin-Shue
(74) *Attorney, Agent, or Firm* — Young & Thompson

(57) ABSTRACT

The invention relates to a lifting appliance which includes a frame (3), wheels (9) mounted on axles (30) of the frame (3), each wheel (9) including a rim (90) having a radial web (92) attached to a rotary element (342) at one of the ends (32) of one of the axles (30), a load support and means for raising the load support. The radial webs (92) of the rims (90) are axially offset towards one (95) of the side edges (94, 95) of the wheels (9) relative to a median plane (P9) of each wheel (9). The wheels (9) are suitable for being mounted on the axles (30) in a first position, corresponding to a usage configuration of the lifting platform in which the median planes (P9) are separated from the frame (3), and in a second position, corresponding to a transport configuration of the lifting platform, in which the median planes (P9) are moved closer to the frame (3). The lifting appliance includes means for signalling the mounting position of the wheels (9) and/or means for limiting the raising of the load support when the wheels (9) are in the second position thereof. The invention also relates to a method for using such a lifting appliance, for (Continued)

example such as a lifting platform (1) supporting a pod (5) mounted on an articulated arm (7).

6 Claims, 5 Drawing Sheets

(56) References Cited

U.S. PATENT DOCUMENTS 4,359,137 A * 11/1982 Merz ..... B66F 17/006 116/298
4,456,093 A * 6/1984 Finley ..... B66F 17/006 182/18
5,282,706 A * 2/1994 Anthony ..... B60P 3/10 24/68 CD
5,489,114 A 2/1996 Ward et al.
6,637,077 B2 * 10/2003 Doty ..... B60P 3/079 24/298
2003/0108410 A1 * 6/2003 Oldak ..... B60P 3/1025 414/462
2003/0173151 A1 * 9/2003 Bodtke ..... B66F 11/046 182/18
2005/0091941 A1 * 5/2005 Baird ..... B66F 11/04 52/633
2005/0224153 A1 * 10/2005 Speyer ..... B60C 13/001 152/524
2006/0028638 A1 * 2/2006 Douglas ..... G01M 1/26 356/139.09
2013/0020775 A1 1/2013 Beji
2013/0087410 A1 * 4/2013 Bowden ..... B66F 11/044 182/63.1
2013/0241161 A1 9/2013 Berry
2016/0311253 A1 * 10/2016 Palmer ..... B60B 21/02

FOREIGN PATENT DOCUMENTS

CN 103552618 2/2014
EP 2537684 12/2012
FR 2 230 537 A1 12/1974
GB 666112 A * 2/1952 ..... B60B 3/042
JP S56 143901 U 10/1981
JP S58 50002 U 4/1983
JP S62 26400 U 2/1987

* cited by examiner

LIFTING APPLIANCE AND METHOD FOR USING SUCH A LIFTING APPLIANCE

BACKGROUND OF THE INVENTION

Field of the Invention

The invention relates to a lifting appliance and a method for using such a lifting appliance.

Description of the Related Art

Personal moving lifting platforms generally include a frame on which wheels, a pod and means for raising the pod are mounted. Such lifting platforms must be transported from one worksite to another by road. To that end, their width must not exceed 2.50 m so as not to require an extra long load. Furthermore, such lifting platforms must sometimes be transported by sea, in particular inside a container. However, the standard dimensions of a container are generally smaller than 2.50 m. It is therefore necessary to limit the maximum width of the lifting platform specifically for transport in a container. This amounts to reducing the track width, i.e., the transverse distance between the wheels on each side of the frame of the lifting platform. This solution is not satisfactory, since the track width is an important parameter for the stability of the lifting platform, and therefore for its usage performance and safety. In order to maintain the stability by reducing the track width, an additional weight can be added, but this solution is impractical and expensive.

The same problem also arises for lifting appliances other than lifting platforms, such as lifting trolleys.

It is also known to replace the normal wheels with narrower metal wheels, or casters. However, these casters are thrown away after use, which involves a substantial excess cost. Furthermore, if the lifting platform is used without having replaced the casters with normal wheels, the stability and safety performance of the lifting platform suffer, and a tipping risk arises.

BRIEF SUMMARY OF THE INVENTION

The invention aims to resolve these drawbacks by proposing a new lifting appliance, the dimensions of which can be adapted simply for transport by container, while guaranteeing its usage performance and safety.

To that end, the invention relates to a lifting appliance which comprises a frame, wheels mounted on axles of the frame, each wheel comprising a rim comprising a radial web attached to a rotary element at one of the ends of one of the axles, a load support and means for raising the load support. This lifting appliance is characterized in that the radial webs of the rims are axially offset towards one of the side edges of the wheels relative to a median plane of each wheel, in that the wheels are suitable for being mounted on the axles in a first position, corresponding to a usage configuration of the lifting platform in which the median planes are remote from the frame, and in a second position, corresponding to a transport configuration of the lifting platform, in which the median planes are moved closer to the frame, and in that the lifting appliance comprises means for signaling the mounting position of the wheels and/or means for limiting the raising of the load support when the wheels are in the second position thereof.

Owing to the structure and the two possibilities for mounting the wheels, the width of the lifting appliance can be reduced for transport in a container, while the performance and usage stability are guaranteed when the wheels are mounted in their usage configuration. The presence of signaling means for the mounting position of the wheels and/or means for limiting the raising of the load support when the wheels are in their second position makes it possible to secure the use of the lifting appliance.

According to advantageous, but optional aspects of the invention, such a lifting appliance may incorporate one or more of the following features, considered in any technically allowable combination:

- The radial web is situated at a distance from the side edge of the wheel to which it is closest corresponding to a value comprised between 10 and 40% of the total width of the wheel.
- The means for signaling the mounting position of the wheels comprise distinctive signs visible from the sides of the lifting appliance.
- The means for limiting the raising of the load support when the wheels are in their second mounting position are suitable for preventing the raising of the load support by a height corresponding to 30% of the maximum lifting height.
- The means for limiting the raising of the load support comprise a program integrated into a control unit of the lifting appliance.
- The program is suitable for being deactivated by entering a code when the lifting appliance must be placed in the usage configuration.
- The means for limiting the raising of the load support comprise at least one strap passing over the lifting means and the ends of which are fastened on the axles such that the strap cannot be removed without disassembling the wheels.
- The appliance comprises two pairs of wheels, the means limiting the raising of the load support comprising two straps crossed over the lifting means.
- Each strap comprises, at each of its ends, a loop having a perimeter smaller than the perimeter of the wheels.

The invention also relates to a method for using a lifting appliance as described above. This method is characterized in that it comprises, when the lifting appliance must be taken from its transport configuration to its usage configuration, the steps consisting of disassembling the wheels, deactivating or disassembling the means for limiting the raising of the load support when the wheels are in their second mounting position, and remounting the wheels in their first mounting position.

BRIEF DESCRIPTION OF THE DRAWINGS

The invention will be better understood, and other advantages thereof will appear more clearly, in light of the following description of a lifting appliance and a method for using a lifting appliance according to its principle, provided as a non-limiting example in reference to the appended drawings, in which.

DETAILED DESCRIPTION OF THE PREFERRED EMBODIMENTS

Figure 1:
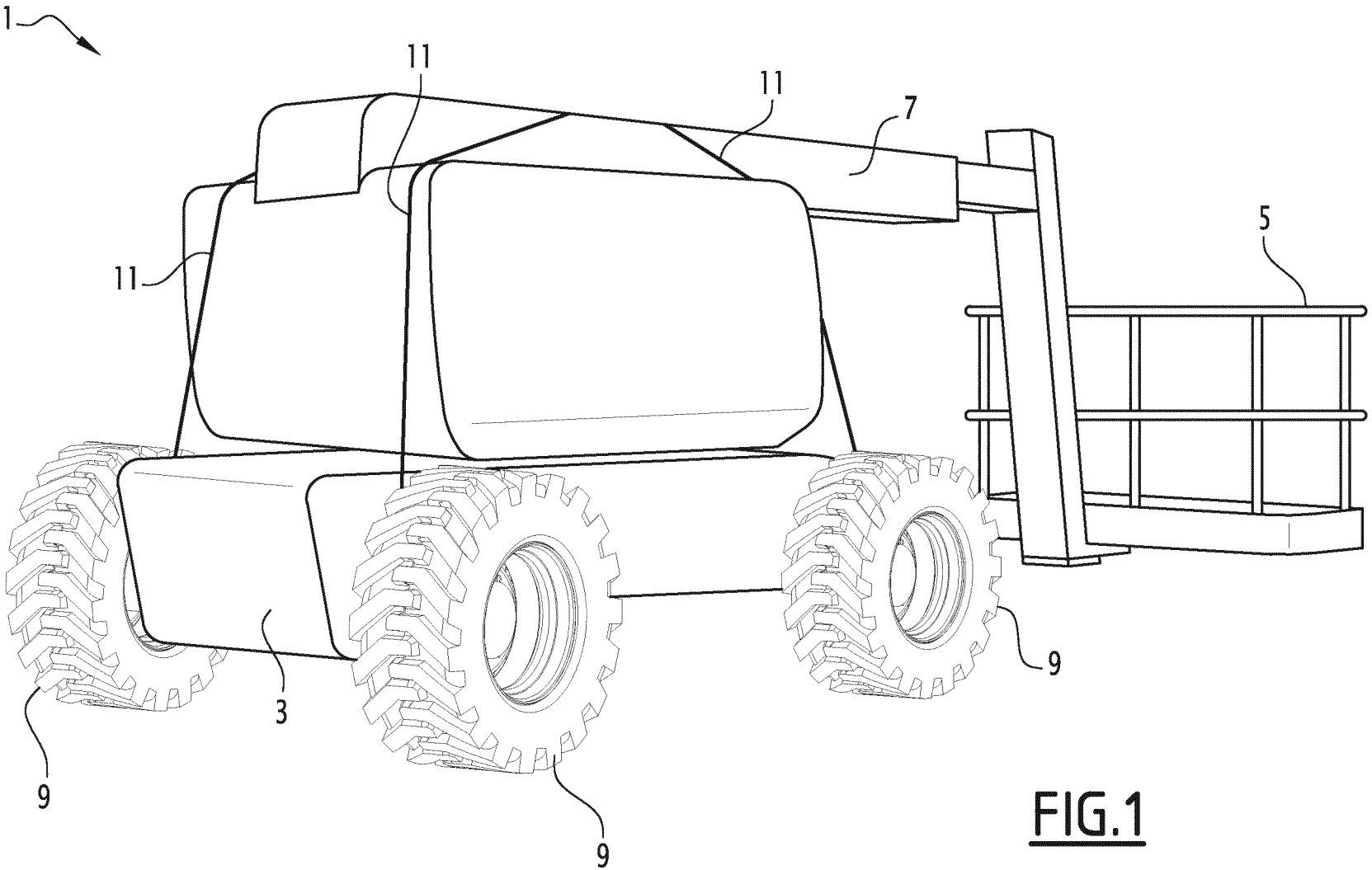
FIG. 1 is a perspective view of a lifting platform according to the invention.
Figure 2:
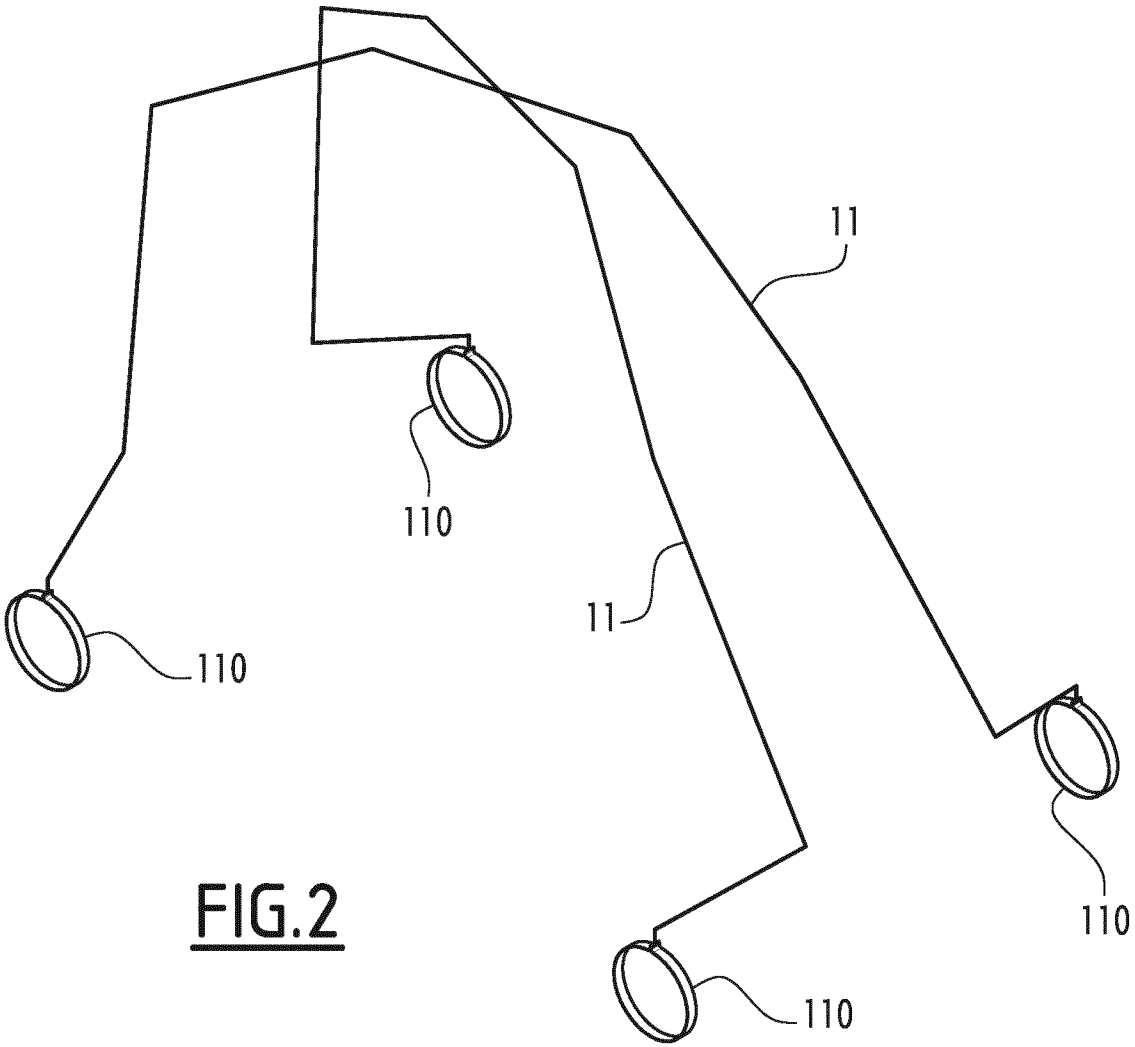
FIG. 2 is a schematic perspective view of a system for limiting the raising of the pod of the lifting platform of FIG. 1.
Figure 3:
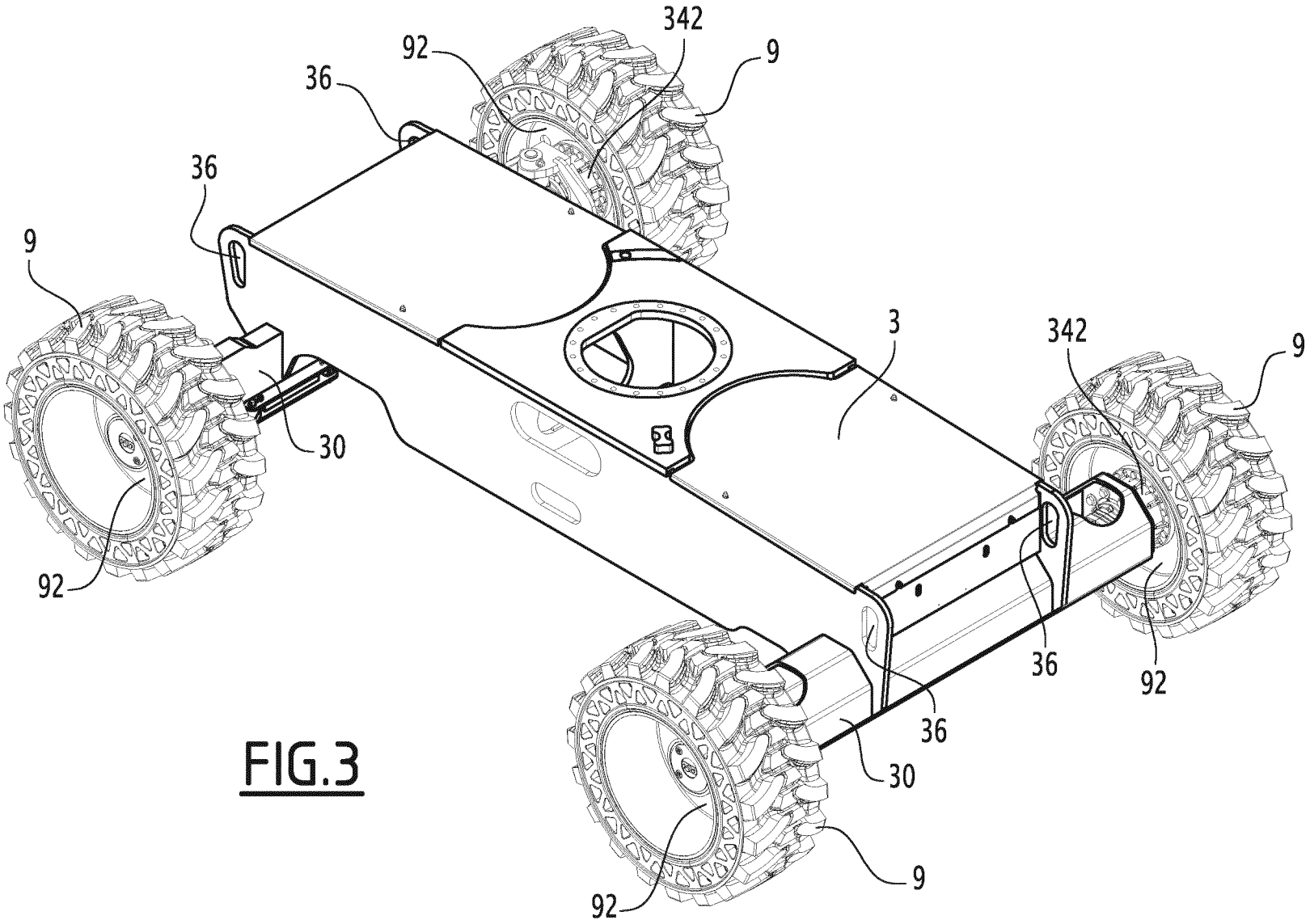
FIG. 3 is a perspective view of a frame of the lifting platform of FIG. 2, in a usage configuration of the lifting platform.

FIG. 1 shows a lifting appliance, a lifting platform 1 in this example, comprising a frame 3, a load support formed by a pod 5 and means for raising the pod 5 formed by an articulated arm 7.

The platform 1 comprises two wheels 9 mounted on axles 30 belonging to the frame 3. The axles 30 are hollow and fastened non-rotatably on the frame 3. Hydraulic motors 34 are fastened to the inside of the axles 30 at the ends 32 of the axles 30. The hydraulic motors 34 comprise output shaft 340 that define rotation axes X-X' of the wheels 9. The wheels 9 are mounted on the output axes 340 via reduction gears 342. The output shafts 340 and the reduction gears 342 form rotary elements secured to the axles 30, and on which the wheels 9 are mounted. The rotation axes X-X' define the transverse direction of the lifting platform 1.

In the present description, the terms "radial", "axial", "axially" and "radially" are used in reference to the rotation axes X-X'.

Each wheel 9 comprises a rim 90 having an axial part 91 on which a tire 93 is mounted, and a radial web 92 extending inside the axial part 91 and that is fastened on a reduction gear 342.

The wheels 9 have two side edges 94 and 95. According to the invention, the radial webs 92 are axially offset toward the side edge 95 of the wheels 9 relative to a median plane P9 of each wheel 9. The median planes P9 extend at equal distances from the edges 94 and 95 of the wheels 9 and perpendicular to the rotation axes X-X' of the wheels 9.

Figure 5:
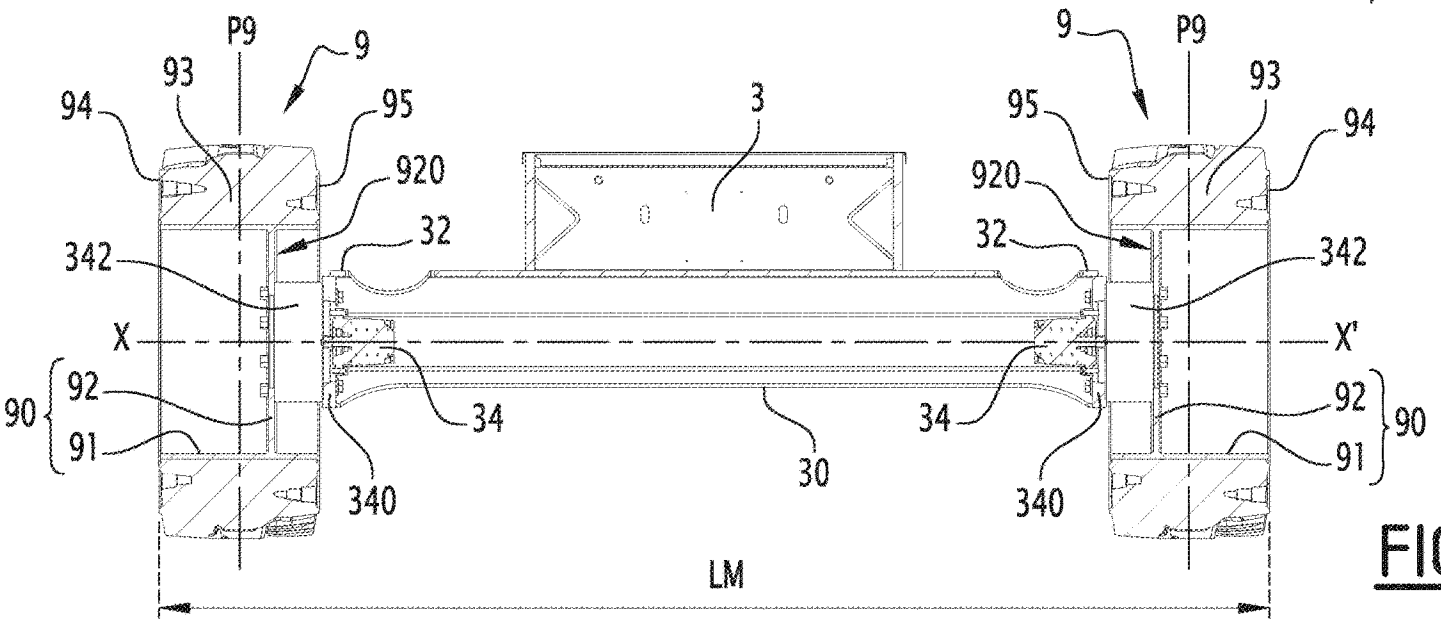
FIG. 5 is a sectional view along plane V-V in FIG. 4, of the frame of FIGS. 3 and 4, in the usage configuration.

Owing to the geometric structure of the rims 90, the wheels 9 are suitable for being mounted on the axles 30 in a first position, shown in FIG. 5, corresponding to an operating configuration of the lifting platform 1. In this configuration, the edges 95 are situated toward an inner side of the wheels 9 and the median planes P9 are moved away from the frame 3 such that the platform 1 has its maximum width LM in this configuration. This operating configuration allows the greatest stability of the platform 1.

Figure 6:
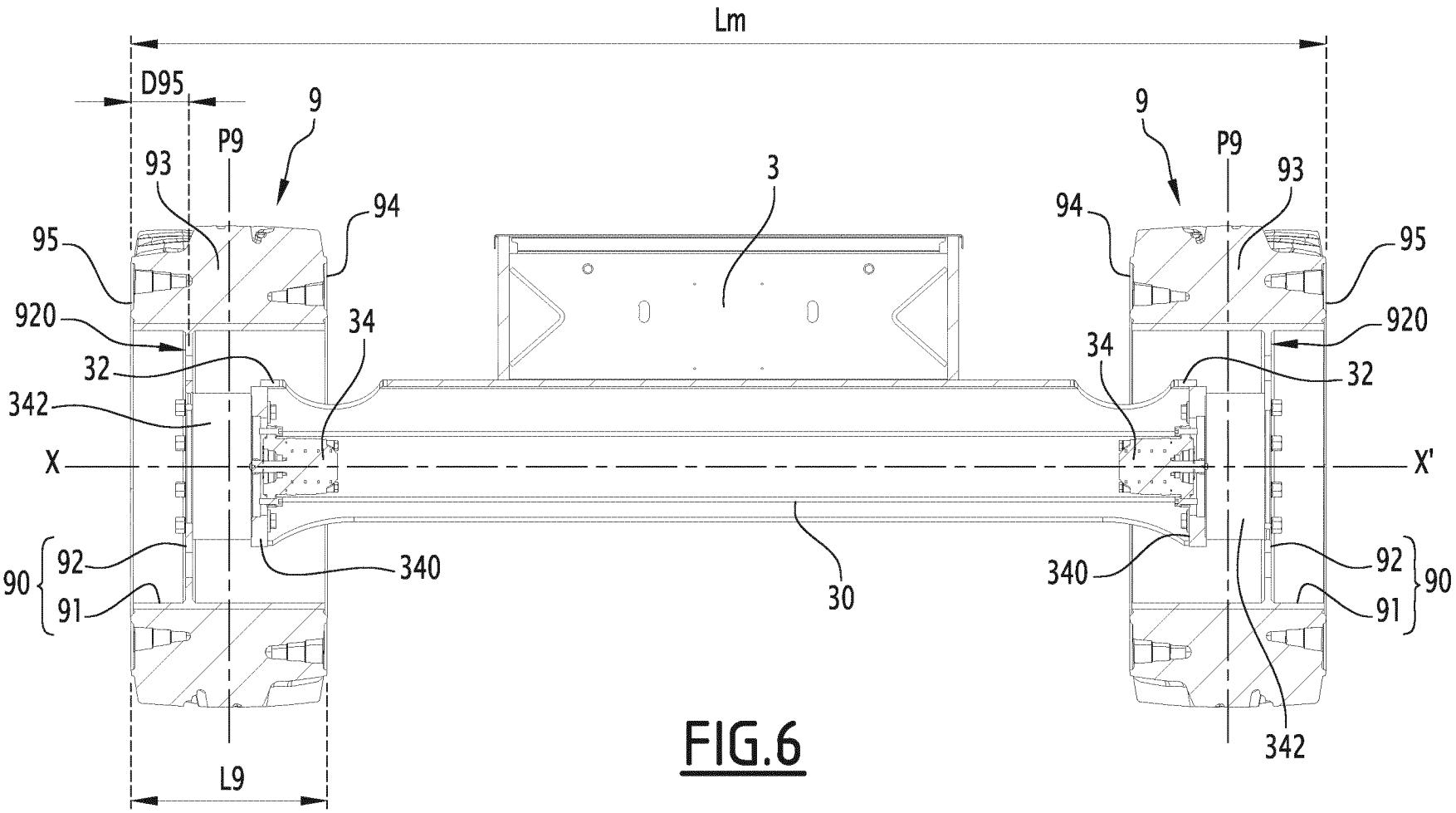
FIG. 6 is a sectional view similar to FIG. 5, in the transport configuration.

The wheels 9 are suitable for being mounted on the axles 30 in a second position, shown in FIG. 6, corresponding to a transport configuration of the lifting platform 1. In this configuration, the side edges 95 are situated on the outer side of the wheels 9, opposite the frame 3, and the median planes P9 are moved closer to the frame 3 such that the ends 32 of the axles 30 are engaged in the wheels 9 more substantially than in the operating configuration. Indeed, in FIG. 6, the planes P9 pass in the reduction gears 342, such that in FIG. 5, in the usage configuration, the planes P9 pass axially beyond the reduction gears 342 toward the outside. In this transport configuration, the platform 1 has a minimal width Lm smaller than the maximum width LM.

Preferably, for each wheel 9, the radial web 92 is situated at a distance D95 from the side edge of the wheel 9 to which it is closest, i.e., the side edge 95, corresponding to a value comprised between 10 and 40% of the total width L61 of the wheel 9.

According to the invention, the lifting platform 1 also comprises means for signaling the mounting position of the wheels 9 and/or means for limiting the raising of the pod 5 when the wheels 9 are in their second mounting position.

In the illustrated example, the platform 1 comprises means for limiting the raising of the pod when the wheels 9 are in their position of FIG. 6. Indeed, when the wheels 9 are in their position of FIG. 6, the width of the lifting platform 1 is reduced, which causes a reduction in the stability of the lifting platform 1 when the pod 5 is raised. In order to limit the raising of the pod 5, the lifting platform 1 comprises straps 11 passing over the raising means 7, and the ends 110 of which are fastened on the axles 30 such that the straps 11 cannot be removed without first disassembling the wheels 9.

The ends 110 comprise loops, the perimeter of which is smaller than the perimeter of the wheels 9, which means that the wheels 9 must be disassembled, then the straps 11 removed, before the raising means 7 for the pod 5 can be actuated.

Preferably, the means for limiting the raising of the pod 5 when the wheels 9 are in their second mounting position are suitable for preventing the raising of the pod 5 by a height corresponding to 30% of the maximum raising height. In this way, the maximum raising height remains within the stability limits allowed by the transport configuration, which increases the usage safety of the lifting platform 1.

Optionally, the frame 3 comprises orifices 36 for the guiding and passage of the straps 11 facilitating their mounting on the axles 30.

The method for using the lifting platform 1 is described below. In an initial transport configuration, the pod 5 is in a low position and the wheels 9 are mounted in their second position, in the transport configuration of the lifting pod 1. Before mounting the wheels in the transport configuration, the straps 11 have been placed by passing the loops of the ends 110 over the axles such that the straps 11 intersect on the raising means 7, making it impossible to raise the pod 5.

When the lifting platform 1 must be used, the wheels 9 are disassembled beforehand. Next, the straps 11 are removed from the axles 30. The wheels 9 are next remounted on the axles 30 in their first position, to obtain the usage configuration of the lifting platform 1.

According to one alternative of the invention that is not shown, the lifting appliance 1 may comprise only one strap 11.

Figure 4:
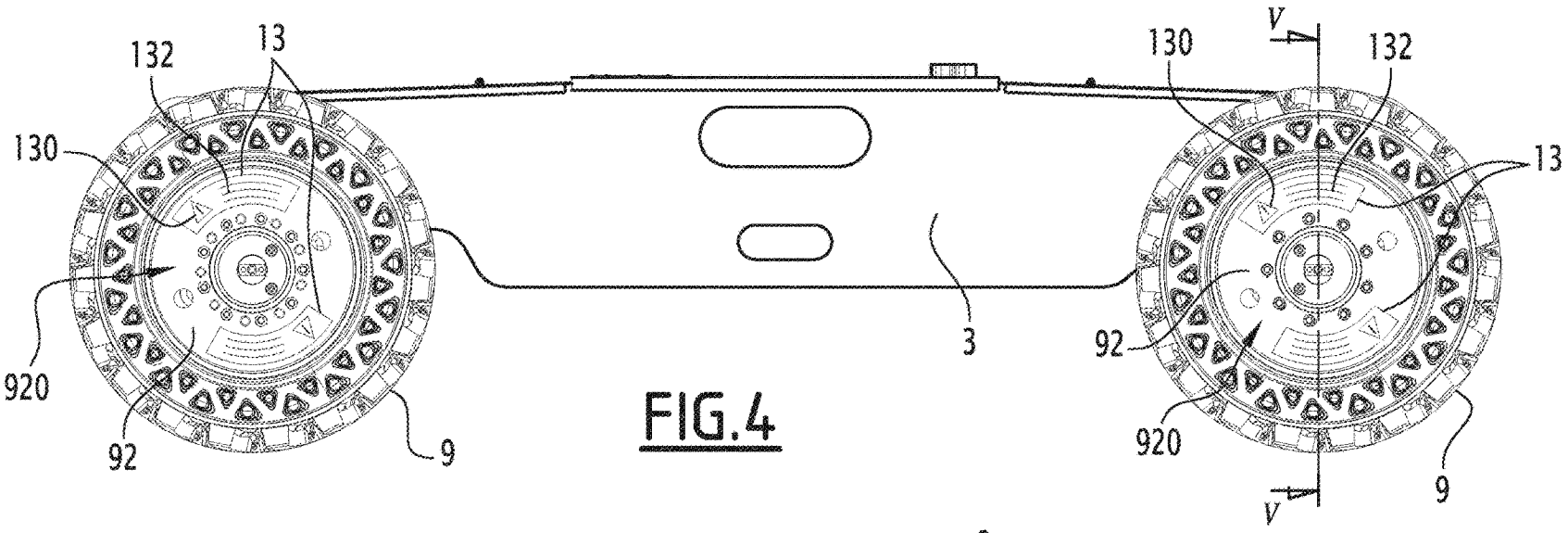
FIG. 4 is a side view of the frame of FIG. 3, in a transport configuration of the lifting platform.

In the illustrated example, the lifting platform 1 also comprises means 13 for signaling the mounting position of the wheels 9, shown in FIG. 4. These signaling means 13 comprise distinctive signs provided on the wheels 9 and visible from the sides of the lifting platform 1 when the wheels 9 are in their second mounting position. The signaling means 13 are preferably provided on one side 920 of the radial webs 92 oriented toward the side edge 95, i.e., on the side of the side edge that is toward the outside when the wheels 9 are in their second mounting position. These distinctive signs for example comprise warning signals 130 making it possible to signal that the wheels 9 are mounted in their position corresponding to the transport configuration. The signaling means 13 can also comprise warning phrases 132 signaling the need to change the mounting of the wheels 9 before any normal use of the platform 1.

Optionally, the signaling means 13 can comprise reflective parts.

According to one embodiment of the invention that is not shown, the means for limiting the raising of the pod 5 can comprise a program integrated into a control unit of the lifting platform 1. This program can be suitable for being deactivated by entering a code when the lifting platform 1 must be placed in the usage configuration. The code may in particular be entered by qualified personnel upon delivery of the lifting platform 1.

According to another embodiment of the invention that is not shown, the lifting platform 1 may comprise only means for limiting the raising of the pod 5, or only means for signaling the mounting position of the wheels 9.

According to another embodiment of the invention that is not shown, the wheels 9 may not be rotated by motors and reduction gears, but may simply be mounted rotating on the axles 30. In such a case, the wheels 9 are mounted on rotary elements such as rolling bearings or main bearings.

The invention also applies to other types of lifting appliances, for example lifting trolleys with a pylon, comprising tool assemblies and able to raise persons or goods. In this case, the load support may be different from the pod 5. The raising means may be different from the articulated arm 7.

The technical features of the embodiments and alternatives described above may be combined to form new embodiments of the invention.

The invention claimed is:

1. A lifting appliance, comprising:

a frame;

wheels mounted on axles of the frame, each wheel comprising a rim comprising a radial web attached to a rotary element at one of the ends of one of the axles;

a load support;

a raising system configured to raise the load support; and one of a signaling system configured to signal a mounting position of the wheels, and a limiting system configured to limit the raising of the load support when the wheels are in the second position thereof, the limiting system comprising at least one strap passing over the raising system and the ends of which are fastened on the axles such that the strap is not configured to be removed without disassembling the wheels, each strap comprising, at each end thereof, a loop having a perimeter smaller than the perimeter of the wheels, wherein the radial webs of the rims are axially offset towards one of side edges of the wheels relative to a median plane of each wheel, wherein the wheels are configured to be mounted on the axles in a first position, corresponding to a usage configuration of the lifting appliance, in which the median planes are remote from the frame, and in a second position, corresponding to a transport configuration of the lifting appliance, in which the median planes are moved closer to the frame.

2. The lifting appliance according to claim 1, wherein the radial web is situated at a distance from the side edge of the wheel to which the radial web is closest, corresponding to a value comprised between 10 and 40% of the total width of the wheel.

3. The lifting appliance according to claim 1, wherein the signaling system comprises distinctive signs visible from the sides of the lifting appliance.

4. The lifting appliance according to claim 1, wherein the limiting system is configured to prevent the raising of the load support by a height corresponding to 30% of the maximum lifting height.

5. The lifting appliance according to claim 1, wherein the wheels include two pairs of wheels, and wherein the limiting system comprises two straps crossed over the raising system.

6. A method for using the lifting appliance according to claim 1, the method comprising, when the lifting appliance must be taken from its transport configuration to its usage configuration:

disassembling the wheels;

deactivating or disassembling the limiting system when the wheels are in the second mounting position; and remounting the wheels in the first mounting position.

* * * * *